US006751868B2

(12) United States Patent
Glesser

(10) Patent No.: US 6,751,868 B2
(45) Date of Patent: Jun. 22, 2004

(54) FOLDING KNIFE WITH A SUBSTANTIALLY SPHERICAL LOCKING MECHANISM

(75) Inventor: Louis S. Glesser, Golden, CO (US)

(73) Assignee: Spyderco, Inc., Golden, CO (US)

( * ) Notice: Subject to any disclaimer, the term of this patent is extended or adjusted under 35 U.S.C. 154(b) by 10 days.

(21) Appl. No.: 10/061,555

(22) Filed: Feb. 1, 2002

(65) Prior Publication Data

US 2003/0145468 A1 Aug. 7, 2003

(51) Int. Cl.[7] ..... B26B 1/04
(52) U.S. Cl. ..... 30/161; 30/160
(58) Field of Search ..... 30/160, 161

(56) References Cited

U.S. PATENT DOCUMENTS 3,930,309 A * 1/1976 Collins ..... 30/161
4,451,982 A 6/1984 Collins ..... 30/161
5,111,581 A 5/1992 Collins ..... 30/161
5,615,484 A 4/1997 Pittman ..... 30/161
5,685,079 A 11/1997 Brothers et al. ..... 30/161
5,737,841 A 4/1998 McHenry et al. ..... 30/161
6,122,829 A * 9/2000 McHenry et al. ..... 30/161

OTHER PUBLICATIONS

Sogknives.com X–ray Vision, pp. 1 and 2.
Sogknives.com Vision Series, pp. 1 and 2.
Sogknives.com, Night Vision, pp. 1 and 2.
Sogknives.com, Sculptura, p. 1.
Sogknives.com, Mini X–ray Vision, pp. 1 and 2.
Benchmade Knives, www.benchmade.com website, "Axis", Dec. 9, 2003, 17 pages.

* cited by examiner

*Primary Examiner*—Douglas D. Watts
(74) *Attorney, Agent, or Firm*—Sheridan Ross P.C.

(57) ABSTRACT

This invention relates to folding knives, and more particularly folding knives which have locking mechanisms which engage the knife blade to prevent the inadvertent closing of the knife blade.

26 Claims, 7 Drawing Sheets

FOLDING KNIFE WITH A SUBSTANTIALLY SPHERICAL LOCKING MECHANISM

FIELD OF THE INVENTION

The present invention relates to hand held folding knives, and more specifically folding knives which have a locking mechanism for engaging the blade to prevent the blade from inadvertently closing.

BACKGROUND OF THE INVENTION

Pocket multi-tools and pocket knives are commonly used by sportsmen, craftsmen and others who desire a compact, portable blade or tool. Unfortunately, many of the implements or blades commonly associated with these types of pocket knives and multi-tools do not have locking mechanisms to prevent the blades from inadvertently closing. Thus, the folding knife or multi-tool can be potentially dangerous to use if a sharpened blade or other implement inadvertently closes.

More recently, locking devices have been incorporated into folding knives and multi-tools to engage the blade with a locking mechanism to prevent the inadvertent closing of the knife blade. One type of locking mechanism known in the art is a "liner lock" which utilizes a leaf spring positioned within the cavity of the knife handle and which engages the heel end of the knife blade. The blade is typically released by the user by applying finger pressure to the leaf spring, thus releasing the leaf spring from the knife blade.

Another commonly used folding knife locking mechanism is a "back lock", which utilizes a locking bar positioned along an upper edge of the knife handle. When finger pressure is applied to the locking bar, a tang interconnected to the locking bar is withdrawn from a cut-out "anvil" portion which is positioned proximate the heel end of the blade. When the tang is released, the knife blade is allowed to rotate between a first extended position of use and a second closed position wherein at least a portion of the knife blade is stored within a cavity in the knife handle.

Unfortunately, with both liner locks and back lock locking mechanisms, it is possible for the locking apparatus, to potentially become disengaged from the blade after excessive and continuous use. Further, the positioning of the liner lock and back lock are often difficult to locate with a user's fingers and thus not ergonomically user friendly, and cannot be accessed on both a front and rear side of the knife handle.

Thus, there is a need for an improved folding knife locking mechanism which is simplistic to construct, uses a minimum number of components and is extremely reliable to prevent the inadvertent closure of the knife blade. There is an additional need for a locking mechanism which is positioned to allow quick and easy access by one or more of a user's fingers on both sides of the knife handle.

SUMMARY OF THE INVENTION

It is thus an aspect of the present invention to provide a locking mechanism for a folding knife or multi-tool which is positioned immediately opposite a user's thumb or fingers and which is thus immediately accessible for selective opening. Thus, in one embodiment of the present invention the lock release mechanism is positioned immediately adjacent to a user's thumb or finger, and may be accessed on both sides of a folding knife handle.

It is a further aspect of the present invention to provide a locking mechanism which has a biasing means which continually biases the locking mechanism to secure the blade while it is in an extended position, and thus cannot be inadvertently closed. Thus, to release the blade the locking mechanism must be engaged by a user's thumb or finger and pushed in a rearward direction by the user, thus making it substantially impossible for the knife locking mechanism to fail. Alternatively, the locking mechanism may be oriented in numerous different directions to accommodate certain handle and blade designs, and may be used without any type of biasing means. In these embodiments, the locking mechanism can be engaged or disengaged with the tang of the folding knife blade by means of gravity or by pressure from a user's fingers.

It is yet another object of the present invention to provide a blade locking mechanism which is simplistic to use, cost effective to manufacture and requires a minimum number of components which are not susceptible to failure after repeated use. Thus, in one embodiment of the present invention a substantially spherical ball is used in conjunction with a biasing means which is positioned within a slot in the knife handle to selectively lock the blade in a first extended position of use, and thus requires only two major components, including the substantially spherical ball and an elongated slot which houses the substantially spherical ball. The substantially spherical ball, as used herein is meant to include all shapes that are round, oval, semi-round, semi-oval, cylindrical, combinations therein, or other feasible shapes which can travel within the elongated slot in the knife handle.

It is a further aspect in one embodiment of the present invention that the elongated slot be oriented with respect to the tang to support the substantially spherical ball in a "morse" type taper, and thus has a greater diameter near the outer edge of the tang than the forward portion of the tang. Preferably, this taper is between about 2–20 degrees, and allows the substantially spherical ball to properly seat between the tang and the elongated slot even after extensive wear to the substantially spherical ball, the tang or the elongated slot.

Thus, in one aspect of the present invention, a folding knife with a substantially spherical locking mechanism is provided, comprising:

DETAILED DESCRIPTION

Figure 1B:
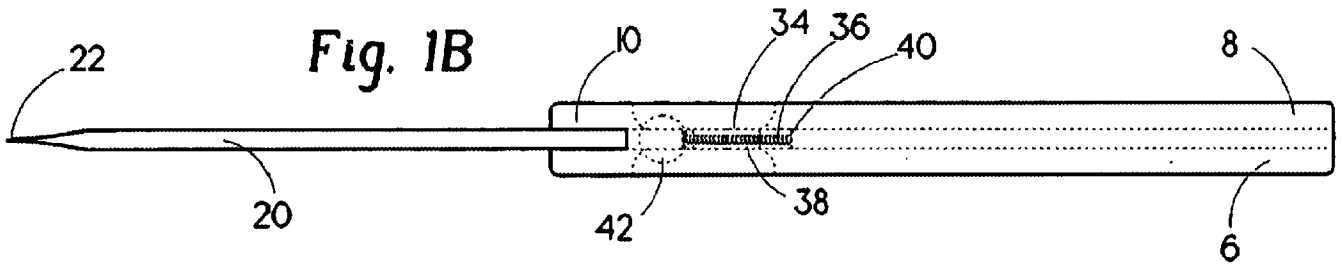
FIG. 1B is a top plan view of the invention shown in FIG. 1A.
Figure 1A:
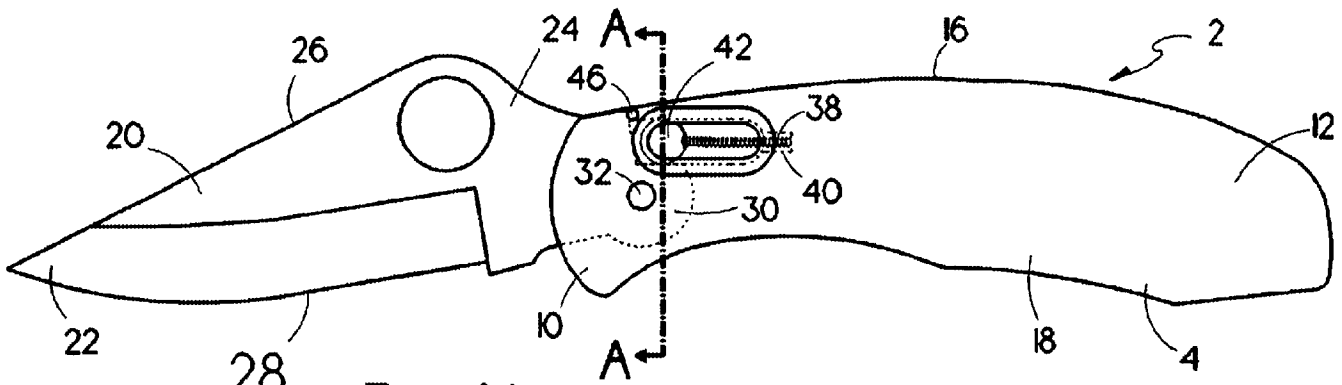
FIG. 1A is a front elevation view of the present invention and showing the knife blade in a first extended position.

Referring now to the drawings, FIG. 1A is a front elevation view of a folding knife 2 with a substantially spherical locking mechanism. Substantially spherical as used herein refers to a round, oval, semi-round, semi-oval, or combinations therein. Alternatively, other shapes such as rectangular, cylindrical, square or geometric configurations which are adapted to slidingly engage in an elongated slot positioned within a folding knife handle may be utilized to perform the same function.

The folding knife 2 of the present invention is generally comprised of a handle 4 with a blade 22 interconnected on the handle front end 10. The blade generally comprises a pointed end 12 and a blade heel end 14 which is rotatably interconnected to the handle front end 10, as well as an upper edge 16 and a lower edge 18. Typically, the lower edge 18 has a sharpened edge. The handle in one embodiment is generally comprised of a front scale 6 and a rear scale 8, which defines a cavity therebetween to receive at least a portion of the knife blade lower edge 18 when the blade is in a closed position. Alternatively, the handle 4 may be comprised of one integral piece with one or more cavities provided to receive a portion of the knife blade 20 and components of the blade locking mechanism. Thus, the blade 20 travels between a first extended position of use where the blade 20 is substantially an extension of the knife handle 4, and a second closed position wherein at least a portion of the blade 20 is received within the handle cavity 14.

Figure 1C:
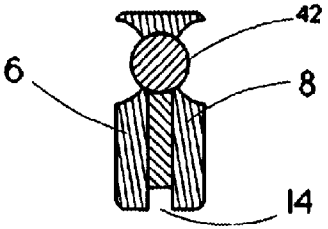
FIG. 1C is a cross-sectional view of the invention shown in FIG. 1A, taken at line A—A.

The folding knife 2 of the present invention includes a locking mechanism to lock the blade in the first extended position of use, and thus prevent the blade 10 from inadvertently closing. Preferably the locking mechanism may also be used to hold the blade in its second closed position of use until such time as a user applies finger pressure upon the blade to rotate the blade around the handle front end 10 to the first position of use. When the blade 20 is in its first extended position of use, in one embodiment the blade upper edge 26 comes in contact with a blade stop pin 46 which prevents the blade from over-extending during use. Referring again to the drawings, FIG. 1A is a front elevation view of a folding knife 2 with the blade 20 in a first extended position of use. FIG. 1B is a top plan view of the knife shown in FIG. 1A, while FIG. 1C is a cross-sectional view taken at line "AA" and which identifies various portions of the blade locking mechanism associated with the folding knife 2. As shown in FIGS. 1A–1C, the folding knife 2 of the present invention is generally comprised of a handle 4 having a front end 10 and a rear end 12, and which is rotatably interconnected to a folding knife blade 20. The blade 20 is rotatably interconnected to the handle front end 10 by a pivot pin 32 or other similar device. The heel end 24 of the blade further comprises a tang 30 which is used to engage the locking mechanism described hereinbelow.

Figure 2B:
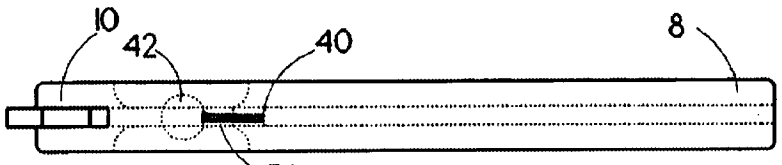
FIG. 2B is a top plan view of the invention shown in FIG. 2A.
Figure 2A:
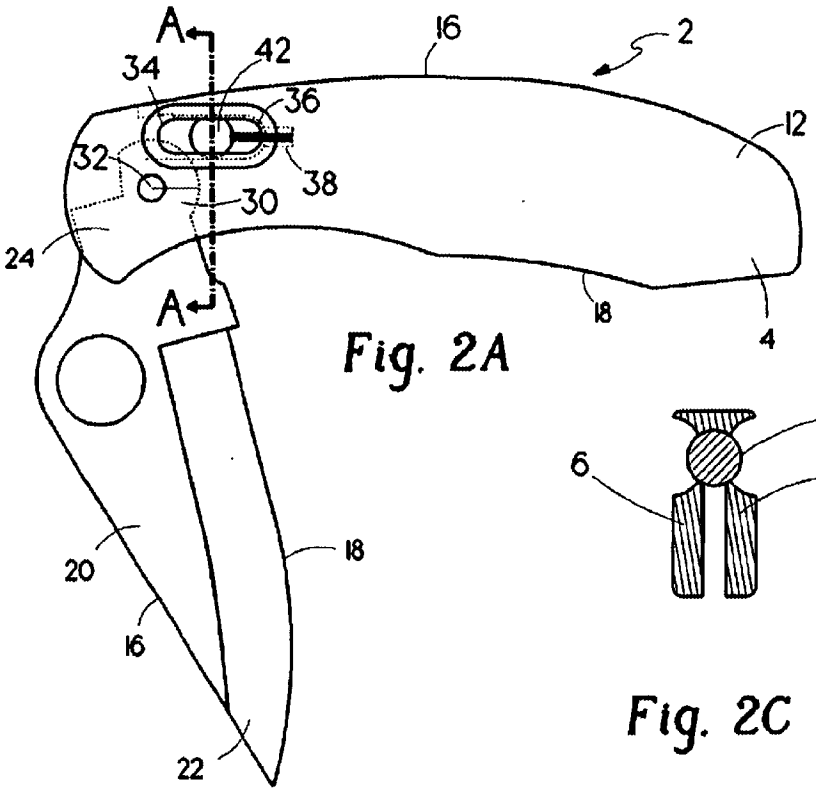
FIG. 2A is a front elevation view of the invention shown in FIG. 1, with the knife blade shown between a first extended position of use and a second closed position.
Figure 2C:
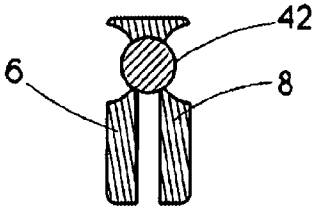
FIG. 2C is a cross-sectional view taken at line A—A in FIG. 2A.
Figure 3B:
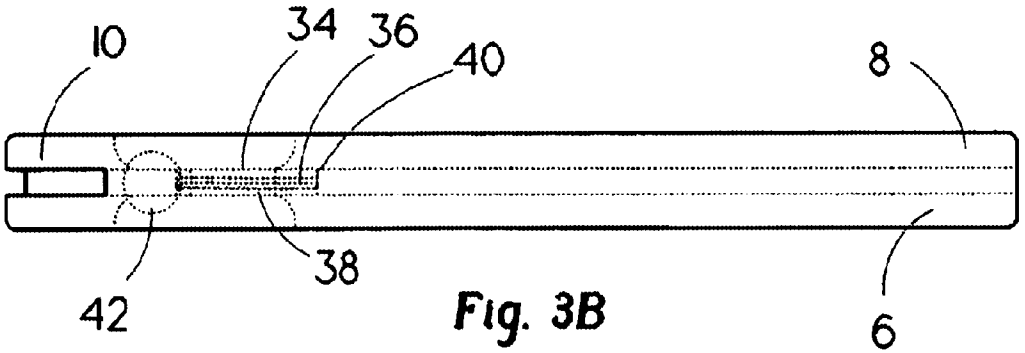
FIG. 3B is a top plan view of the invention shown in FIG. 3A.
Figure 3A:
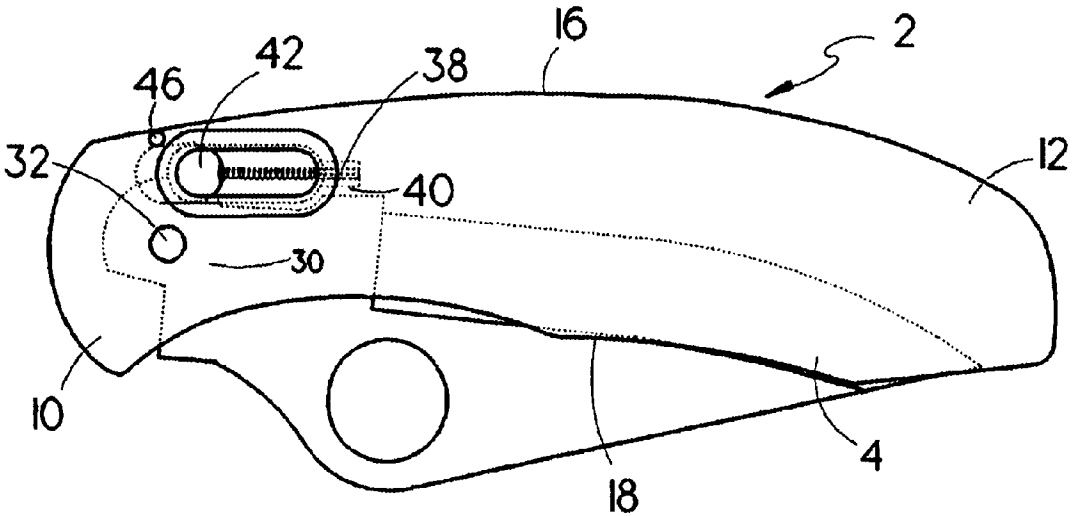
FIG. 3A is a front elevation view of the invention shown in FIG. 1A, with the knife blade shown in a second closed position.

The blade 20 is rotatably interconnected to the handle front end 10 to allow the blade 20 to rotate between the first extended position of use as shown in FIG. 1A, to a second closed position as shown in FIGS. 3A and 3B. FIGS. 2A–2C, shows the respective components of the folding knife 2 and associated locking mechanism with the knife blade 20 shown in an intermediate position between the first extended position of use and the second closed position.

Referring again to FIGS. 1A–1C, and FIGS. 2A–2C, the locking mechanism in one embodiment of the present invention generally comprises an elongated slot having a front end 34 and a rear end 36. The elongated slot generally supports a substantially spherical ball 42 positioned therein which travels between the front end 34 and the rear end 36. The substantially spherical ball 42 is biased in one embodiment in a forward position by the use of a coil spring 38, which is housed within a spring cavity 40. As appreciated by one skilled in the art, the spring or biasing means may alternatively be a leaf spring, or other commonly known biasing apparatus. To contain a portion of the spring 38 with the knife handle, a spring cavity 40 is provided in one embodiment which houses at least a portion of the spring 38 and which prevents the spring from becoming disengaged and/or lost.

Alternatively, in another embodiment of the present invention no biasing mechanism is necessary, and the substantially spherical ball 42 travels between a forward and rearward position in the elongated slot by means of gravity, or alternatively with finger pressure. In another embodiment, the outer diameter of the substantially spherical ball is designed to have a very close tolerance to the interior diameter of the elongated slot to create a frictional engagement, and thus is incapable of travel without the application of finger pressure.

As stated above, the substantially spherical ball 42 of the present invention may be comprised of a substantially round ball such as a ball bearing shape, or alternatively may comprise a spherical, semi-spherical or elongated shape which travels between the front end 34 and rear end 36 of the elongated slot. Preferably, the substantially spherical ball 42 is comprised of a durable metallic material such as stainless steel, although other hardened materials such as plastic, fiberglass, or other materials commonly known in the art may be sufficient for the same purpose.

In use, when the knife blade 20 is in a first extended position, the substantially spherical ball 42 is positioned in a front end of the elongated slot 34, and engages the tang positioned on the heel end of the blade 20. With the substantially spherical ball 42 positioned immediately above the tang 30, the blade 20 is prevented from rotating to a second closed position since the blade tang 30 is in direct contact with the substantially spherical ball 42. To disengage the substantially spherical ball 42 from the elongated slot and tang 30, a rearward force is applied to the substantially spherical ball 42, thus moving the substantially spherical ball 42 from the elongated slot front end 34 to the elongated slot rear end 36. Once the substantially spherical ball 42 is removed from contact with the tang 30, the knife blade 20 is allowed to rotate to the second closed position.

Referring now to FIGS. 3A and 3B, the folding knife 2 shown in FIGS. 1A and 2A is shown with the knife blade 20 in a closed position in both a front elevation and top plan view, respectfully. The various components of the locking mechanism may additionally be seen in greater detail, as well as the substantially spherical ball 42 positioned against and indent in the blade heel end 24, which helps keep the blade closed until finger pressure is applied for opening.

Figure 5:
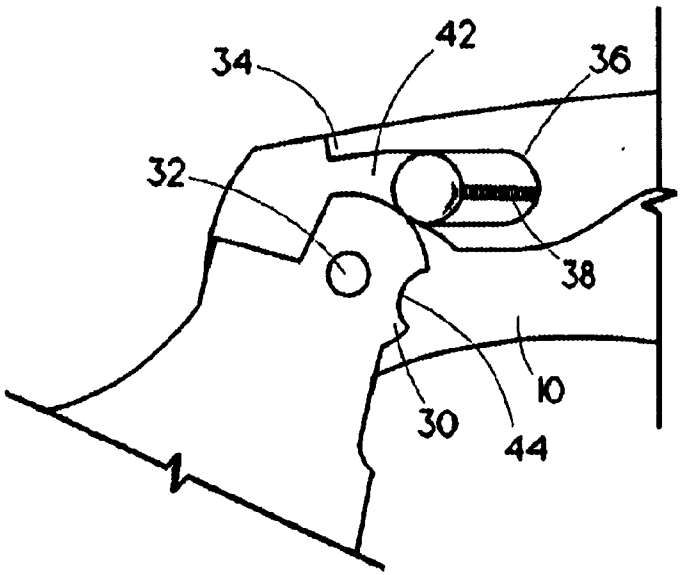
FIG. 5 is a front elevation view of the invention shown in FIG. 1A with the knife blade shown between a first extended position and a second closed position.
Figure 4:
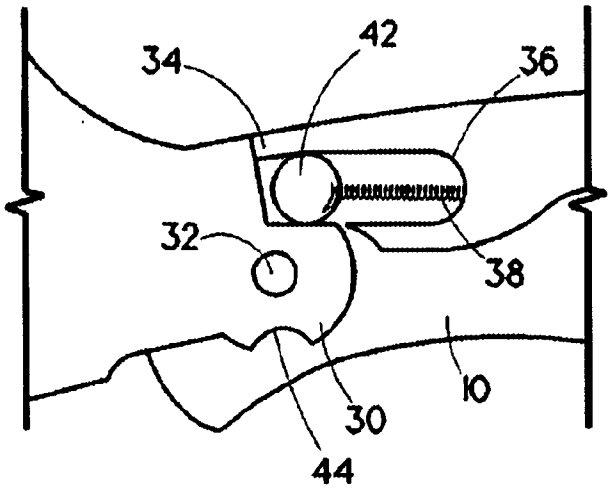
FIG. 4 is a front elevation view of the invention shown in FIG. 1A and showing the blade heel and, tang and a biasing spring used in the present invention.
Figure 6:
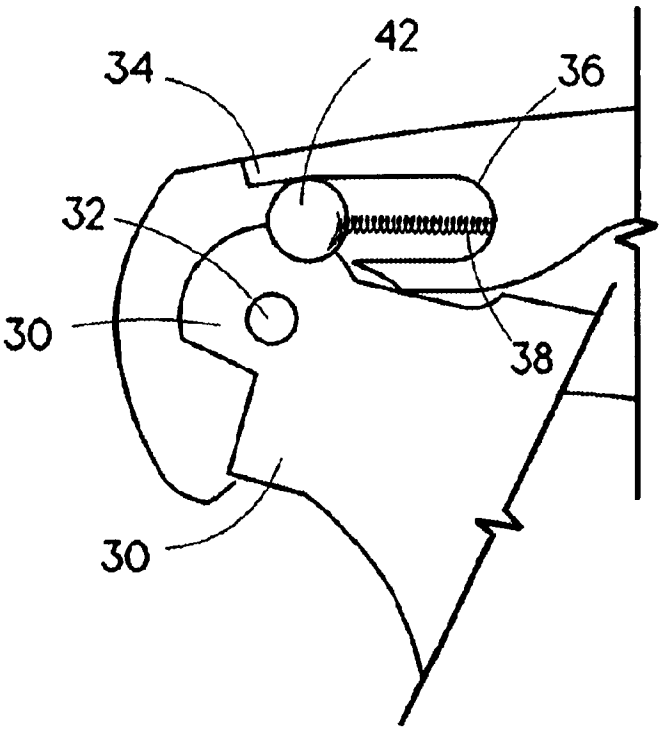
FIG. 6 is an expanded view of the invention shown in FIG. 5, and just prior to the blade being in a second closed position.

Referring now to FIGS. 4–6, more detailed drawings are provided which further identify the various components of the folding knife locking mechanism. More specifically, FIG. 4 shows the knife blade 20 in a first extended position of use, while FIG. 5 shows the knife blade 20 in a partially closed position, and FIG. 6 is a drawing showing the knife blade 20 in a substantially closed position. As shown in each of these drawings, the positioning of the substantially spherical ball 42 in relationship to the tang 30, is identified as well as the position of the substantially spherical ball 42 in the elongated slot and the compression of the biasing spring 38.

Further, a blade second tang 44 is provided in one embodiment of the present invention and which engages the substantially spherical ball 42 when the knife blade 20 is in a closed position, i.e., the blade lower edge 28 is positioned substantially within the handle cavity 14. In this embodiment, the substantially spherical ball 42 inhibits the knife blade 20 from opening to an extended position of use until finger pressure is applied to the blade 20 to promote rotation. As identified in the drawings, the blade second tang 44 is generally positioned on a lower end of the blade heel end 24.

Figure 7:
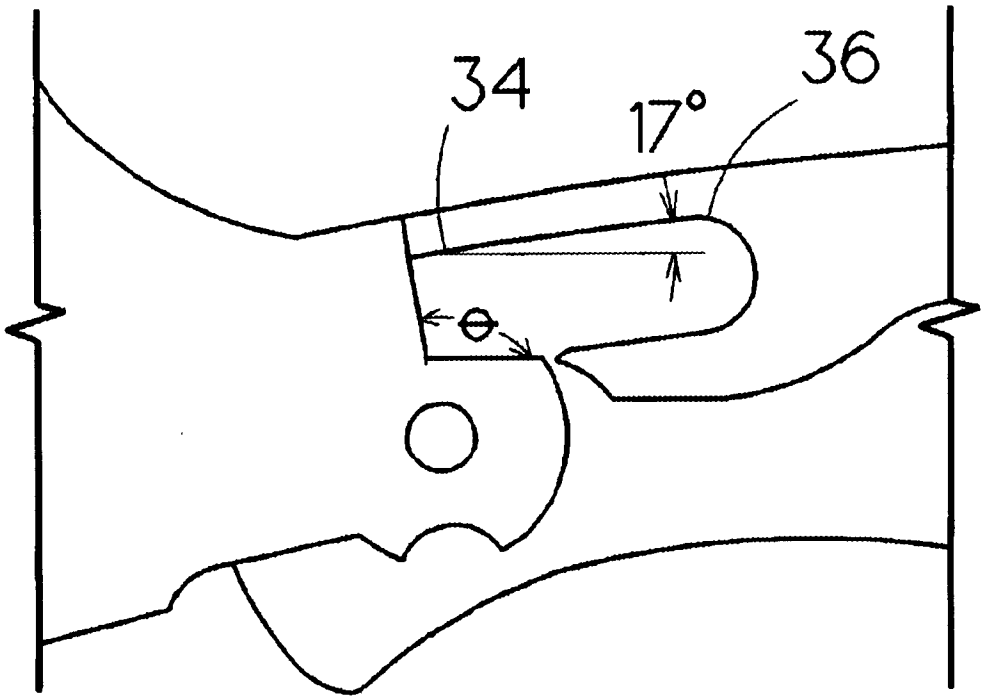
FIG. 7 is an expanded view of the locking mechanism of the present invention and showing a tapered angle created between the tang and elongated slot for receiving a substantially spherical ball.

Referring now to FIG. 7, in yet another embodiment of the present invention, the elongated slot which houses the substantially spherical ball 42 is shown oriented with respect to the tang. This orientation develops a "morse" type taper to provide a close tolerance between the elongated slot front end 34, the substantially spherical ball 42, and the blade tang 30. Thus, the rear end 36 of the elongated slot has a greater diameter than the front end of the elongated slot 34 with respect to the blade tang 30, and allows the substantially spherical ball 42 to seat tightly in the elongated slot over time as wear occurs to the substantially spherical ball 42, elongated slot rear end 36 or blade tang 30. The blade tang angle θ defines an angle preferably between about 90–120 degrees which creates an angle with respect to the elongated slot and substantially eliminates unwanted movement of the substantially spherical ball 42 when it is engaged in the elongated slot and blade tang 30. As appreciated by one skilled in the art, the blade tang angle θ may also be less than 90 degrees as long as the blade tang 30 is oriented with respect to the elongated slot in a manner which gradually decreases the diameter between the blade tang 30 and elongated slot as the substantially spherical ball 42 travels from the elongated slot rear end 36 toward the elongated slot front end 34.

Figure 9:
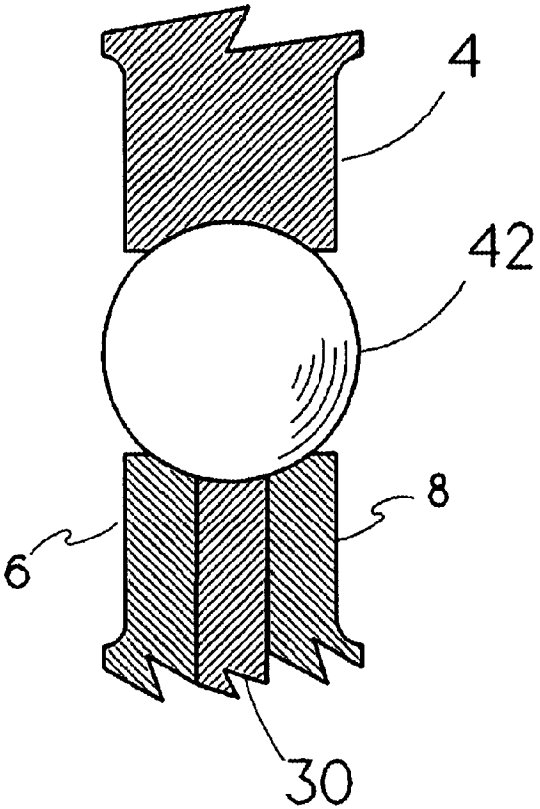
FIG. 9 is a cross-sectional view showing the substantially spherical ball positioned within the elongated slot proximate to a midsection of the tang.
Figure 8:
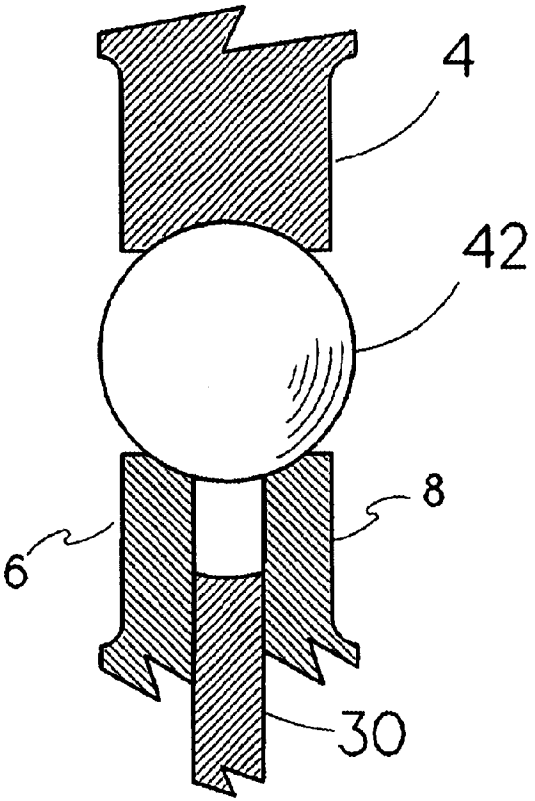
FIG. 8 is a cross-sectional view showing a substantially spherical ball positioned within the elongated slot proximate to the rear end of the tang.

Referring now to FIGS. 8 and 9, FIG. 8 is a cross-sectional, right elevation view taken at the elongated slot rear end 36, and which identifies the relationship between the substantially spherical ball 42 and the elongated slot rear end 36. As shown in this drawing, there is clearance (exaggerated in drawing) between the substantially spherical ball 42 and the blade tang 30, which permits travel in a forward direction of the substantially spherical ball 42. In FIG. 9, which is a cross sectional right elevation view of the elongated slot as shown in FIG. 8, but near the elongated slot front end 34, the substantially spherical ball 42 is now seated in contact with the elongated slot front end 34 and blade tang 30, and thus eliminating any clearance between the blade tang 30 and the substantially spherical ball 42. Thus, the elongated slot in one embodiment is oriented at the angle with respect to the blade tang 30 to provide a high degree of tolerance and to secure the blade 20 in a first extended position to the knife handle 4. Accordingly, when the folding knife of the present invention is new, the substantially spherical ball 42 will preferably engage the blade tang 30 near a rearward portion. Over time, as wear develops in the elongated slot, substantially spherical ball 42 or blade tang 30, the substantially spherical ball 42 will tend to engage the blade tang 30 in a more forward position, and is thus self adjusting.

To provide further clarity to the detailed description provided herein in the associated drawings, the following list of components and associated numbering are provided as follows:

| Component No. | Component |
|---|---|
| 02 | Folding Knife |
| 04 | Handle |
| 06 | Front scale |
| 08 | Rear scale |
| 10 | Handle front end |
| 12 | Handle rear end |
| 14 | Handle cavity |
| 16 | Handle upper edge |
| 18 | Handle lower edge |
| 20 | Blade |
| 22 | Blade front end |
| 24 | Blade heel end |
| 26 | Blade upper edge |
| 28 | Blade lower edge |
| 30 | Blade tang |
| 32 | Pivot pin |
| 34 | Elongated slot front end |
| 36 | Elongated slot rear end |
| 38 | Spring |
| 40 | Spring cavity |
| 42 | Ball |
| 44 | Blade second tang |
| 46 | Blade stop pin |
| θ | Tang angle |

The foregoing description of the present invention has been presented of illustration and description. Furthermore, the description is not intended to limit the invention to the form disclosed herein. Consequently, variations and modifications commensurate with the above teachings and skill and knowledge of the relevant art are within the scope of the present invention. The embodiments described herein above are further intended to explain best modes of practicing invention and to enable others skilled in the art to utilize the invention in such, or other embodiments with various modifications required by the particular application(s) or use(s) of the present invention. It is intended that the appended claims be construed to include alternative embodiments to the extent permitted by the prior art.

What is claimed is:

1. A locking mechanism adapted for use with a folding knife, comprising:

a substantially spherical ball operably sized to travel between a front end and a rear end of an elongated slot operably positioned in a forward portion of a folding knife handle, at least a portion of said substantially spherical ball exposed for engagement with a user's finger;

a biasing means operably engaged to said substantially spherical ball on a first end and the folding knife handle on a second end, wherein said ball is biased in a forward position in said elongated slot; and wherein when the blade of the folding knife is extended in a first position of use, said substantially spherical ball is adapted for operable engagement with a tang positioned on a heel end of the folding knife blade, wherein the blade is substantially prevented from rotating, and wherein when said substantially spherical ball is withdrawn from said tang said blade may rotate to a second closed position with at least a portion of the blade positioned within a cavity in the folding knife handle.

2. The locking mechanism of claim 1, wherein said elongated slot is tapered with a forward end having a smaller diameter than a rearward end.

3. The locking mechanism of claim 1, wherein said biasing means is a coil spring.

4. The locking mechanism of claim 1, wherein said biasing means is a leaf spring.

5. The locking mechanism of claim 1, wherein said substantially spherical ball has a diameter no greater than about 0.33 inches.

6. The locking mechanism of claim 1, wherein said substantially spherical ball is comprised of a metallic material.

7. The locking mechanism of claim 1, wherein said substantially spherical ball is adapted for engagement by a user's fingers on either a front side or a back side of the folding knife handle.

8. The locking mechanism of claim 1, wherein said elongated slot has a length no greater than about two times a diameter of said substantially spherical ball.

9. The locking mechanism of claim 1, wherein said substantially spherical ball inhibits the folding knife blade from opening when the folding knife blade is in the second closed position.

10. The locking mechanism of claim 1, wherein said substantially spherical ball is round.

11. The locking mechanism of claim 1, wherein said substantially spherical ball is oval shaped.

12. The locking mechanism of claim 1, wherein at least a portion of said substantially spherical ball is compressed between said tang and a stop pin when the folding knife blade is in said first position of use.

13. The locking mechanism of claim 1, further comprising a second tang positioned on said heel end of said folding knife blade, wherein when said blade is in said closed position said substantially spherical ball engages said second tang and inhibits said blade from traveling to said first extended position of use.

14. A folding knife with a substantially spherical ball locking mechanism, comprising:

a handle having a front end, a rear end an upper edge and a lower edge;

a cavity positioned between said front end and said rear end of said handle and proximate to said lower edge;

a blade having a front end, a heel end, an upper edge and a lower edge, said heel end rotatably interconnected to said front end of said handle wherein said blade travels from a first extended position of use wherein said blade is substantially an extension of said handle, and a second closed position with at least a portion of said blade lower edge positioned within said cavity;

an elongated slot positioned within said handle proximate to said front end and comprising a front end and a rear end;

a substantially spherical ball positioned within said elongated slot which operably travels between said front end and said rear end of said elongated slot;

a biasing means in operable engagement with said substantially spherical ball and said handle which provides a forward force on said substantially spherical ball, wherein when said substantially spherical ball engages a tang on said heel end of blade, said blade is substantially locked in said first extended position, and when said substantially spherical ball is retracted from engagement with said tang, said blade is unrestricted to rotate to said second closed position.

15. The folding knife of claim 14, wherein said biasing means is a coil spring.

16. The folding knife of claim 14, wherein said biasing means is a leaf spring.

17. The folding knife of claim 14, wherein said substantially spherical ball is round.

18. The folding knife of claim 14, wherein said substantially spherical ball is oval.

19. The folding knife of claim 14, wherein said biasing means is recessed within a cavity positioned within said folding knife handle.

20. The folding knife of claim 14, further comprising a second tang positioned on said heel end of said folding knife blade, wherein when said blade is in said closed position said substantially spherical ball engages said second tang and inhibits said blade from traveling to said first extended position of use.

21. A folding knife with a blade locking mechanism, comprising:

a handle having a front end, a rear end and a cavity extending therebetween positioned proximate to a lower edge;

a blade having a front end, a heel end, an upper edge and a lower edge, said heel end rotatably interconnected to said front end of said handle wherein said blade travels from a first extended position of use and a second closed position with at least a portion of said blade lower edge contained within said cavity;

an elongated slot positioned within said handle proximate to said front end and comprising a front end and a rear end;

a substantially spherical ball positioned within said elongated slot which operably travels between said front end and said rear end of said elongated slot, wherein when said substantially spherical ball is in said front end of said elongated slot said substantially spherical ball engages a tang on said heel end of blade, wherein said blade is locked in said first extended position until said ball is retracted away from said tang, wherein said blade is unrestricted to rotate to said second closed position.

22. The folding knife of claim 21, further comprising a biasing means in operable engagement with said substantially spherical ball and said handle, wherein said substantially spherical shaped ball is biased toward said front end of said elongated slot.

23. The folding knife of claim 22, wherein said biasing means comprises a coil spring.

24. The folding knife of claim 22, further comprising a spring cavity positioned within a portion of said handle which encloses at least a portion of said biasing means.

25. The folding knife of claim 21, wherein said substantially spherical ball is exposed for engagement by a user's's fingers on a front scale and a rear scale of said knife handle.

26. The folding knife of claim 21, further comprising a second tang positioned on said heel end of said folding knife blade, wherein when said blade is in said closed position said substantially spherical ball engages said second tang and inhibits said blade from traveling to said first extended position of use.

* * * * *